US006685882B2

(12) United States Patent
Deevi et al.

(10) Patent No.: US 6,685,882 B2
(45) Date of Patent: Feb. 3, 2004

(54) IRON-COBALT-VANADIUM ALLOY

(75) Inventors: Seetharama C. Deevi, Midlothian, VA (US); Rangaraj S. Sundar, Midlothian, VA (US); Dwadasi H. Sastry, Midlothian, VA (US)

(73) Assignee: Chrysalis Technologies Incorporated, Richmond, VA (US)

( * ) Notice: Subject to any disclaimer, the term of this patent is extended or adjusted under 35 U.S.C. 154(b) by 17 days.

(21) Appl. No.: 09/757,625

(22) Filed: Jan. 11, 2001

(65) Prior Publication Data

US 2002/0127132 A1 Sep. 12, 2002

(51) Int. Cl.[7] ..... C22C 37/10; C22C 38/12

(52) U.S. Cl. ..... 420/124; 420/127; 148/311

(58) Field of Search ..... 420/127, 435, 420/124; 148/311, 313, 315, 320, 425

(56) References Cited

U.S. PATENT DOCUMENTS

| | | | | |
|---|---|---|---|---|
| 2,603,562 A | | 7/1952 | Rapatz | |
| 3,375,105 A | | 3/1968 | Lynch | |
| 3,568,172 A | * | 3/1971 | Lesher | 365/85 |
| 3,622,406 A | | 11/1971 | Vordahl | |
| 3,624,568 A | * | 11/1971 | Olsen | 335/53 |
| 3,634,072 A | * | 1/1972 | Ackermann et al. | 420/581 |
| 3,891,475 A | | 6/1975 | Tomita et al. | |
| 3,977,919 A | | 8/1976 | Foster et al. | |
| 4,103,195 A | * | 7/1978 | Torossian et al. | 310/259 |
| 4,116,727 A | | 9/1978 | Major | |
| 4,247,601 A | * | 1/1981 | Wiegand | 428/611 |
| 4,439,236 A | | 3/1984 | Ray | |
| 4,647,427 A | | 3/1987 | Liu | |
| 4,743,513 A | | 5/1988 | Scruggs | |

(List continued on next page.)

FOREIGN PATENT DOCUMENTS

| | | | | |
|---|---|---|---|---|
| JP | 50-082592 A | * | 7/1975 | H01F/51/28 |
| JP | 59-162251 A | * | 8/1984 | C22C/38/14 |
| JP | 63-004036 A | * | 1/1988 | C22C/19/07 |

OTHER PUBLICATIONS

Lee et al, editors, "Powder Metal Technologies and Applications", ASM Handbook vol. 7, 1998, pub. by ASM International, pp. 9–15, 80–90 and 408–419.*

International Search Report for PCT/US01/48563, dated Mar. 25, 2002.

Colegrove, Phillip G. et al., "Integrated Power Unit for a More Electric Airplane", AIAA/AHS/ASEE Aerospace Design Conference, Feb. 16–19, 1993, Irvine, CA, pp. 1–9.

Fingers, Richard T. et al., "Mechanical Properties of Iron–Cobalt Alloys for Power Applications", IECEC–97, Proceedings of the Thirty–Second Intersociety Energy Conversion Engineering Conference, vol. 1, Aerospace Power Systems and Technologies, Jul. 27–Aug. 1, 1997, Honolulu, Hawaii, pp. 563–568.

Kawahara, Kohji et al., "A possibility for developing high strength soft magnetic materials in FeCo–X alloys", *Journal of Materials Science* (1984), pp. 2575–2581.

Kawahara, Kohji, "Effect of additive elements on cold workability in FeCo alloys", *Journal of Materials Science* 18 (1983), pp. 1709–1718.

*Primary Examiner*—Roy King
*Assistant Examiner*—Harry D. Wilkins, III
(74) *Attorney, Agent, or Firm*—Burns, Doane, Swecker & Mathis, LLP

(57) ABSTRACT

A high strength soft magnetic Fe–Co–V alloy, comprising, in weight %, (Fe+Co)≧88%, (Fe–Co)≧2% or (Co–Fe)≧2%, at least 30% Co, and satisfying one of the following three conditions: (1) 0.05 to 4% Mo and 1.5 to 10% V, or (2) (Fe–Co) or (C0–Fe)≦13 and at least 4% V, or (3) at least 7% V. Additional alloying constituents, including B, C, Nb, Ti, W and Ni can be present.

23 Claims, 14 Drawing Sheets

U.S. PATENT DOCUMENTS 4,933,026 A 6/1990 Rawlings et al.
5,024,542 A 6/1991 Tanaka
5,032,355 A * 7/1991 Achikita et al. ..... 419/23
5,067,993 A 11/1991 Wakita et al.
5,122,337 A 6/1992 Lund et al.
5,252,940 A * 10/1993 Tanaka ..... 148/311
5,338,508 A * 8/1994 Nitta et al. ..... 420/120
5,443,787 A 8/1995 Mori et al.
5,501,747 A * 3/1996 Masteller et al. ..... 148/311
5,503,654 A 4/1996 Takahashi et al.
5,741,374 A 4/1998 Li
5,817,191 A * 10/1998 Emmerich et al. ..... 148/311
6,146,474 A * 11/2000 Coutu et al. ..... 148/315
6,225,556 B1 5/2001 Saito

* cited by examiner

IRON-COBALT-VANADIUM ALLOY

BACKGROUND OF THE INVENTION

1. Field of the Invention

This invention relates to high temperature, high strength magnetic alloys with high saturation magnetization useful for applications such as rotors, stators and/or magnetic bearings of an auxiliary power unit of an aircraft jet engine.

2. State of the Art

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Binary iron-cobalt (Fe–Co) alloys containing 33–55% cobalt (Co) are extremely brittle due to the formation of an ordered superlattice at temperatures below 730° C. The addition of about 2% vanadium (V) inhibits this transformation to the ordered structure and permits the alloy to be cold-worked after quenching from about 730° C. The addition of V also benefits the alloy in that it increases the resistivity, thereby reducing the eddy current losses.

Fe–Co–V alloys have generally been accepted as the best commercially available alloy for applications requiring high magnetic induction at moderately high fields. V added to 2 wt. % has been found not to cause a significant drop in saturation and yet still inhibit the ordering reaction to such an extent that cold working is possible.

However, conventional Fe–Co–V alloys employing less than 2% by weight vanadium have undesirable inherent properties. For example, when the magnetic material undergoes a large magnetic loss the energy efficiency of the magnetic material deteriorates significantly. In addition, conventional Fe–Co–V alloys exhibit certain unsuitable magnetic properties when subjected to rapid current fluctuations. Further, as the percentage of V exceeds 2 wt. %, the DC magnetic properties of the material deteriorate.

In a common form, the composition of Fe–Co–V soft magnetic alloys exhibit a balance between favorable magnetic properties, strength, and resistivity as compared to magnetic pure iron or magnetic silicon steel. These types of alloys are commonly employed in devices where magnetic materials having high saturation magnetic flux density are required. Fe–Co–V alloys have been used in a variety of applications where a high saturation magnetization is required, i.e. as a lamination material for electrical generators used in aircraft and pole tips for high field magnets. Such devices commonly include soft magnetic material having a chemical composition of about 48–52% by weight Co, less than about 2.0% by weight V, incidental impurities and the remainder Fe.

U.S. Pat. No. 4,647,427 to Liu discloses examples of Fe–Co–V alloys containing long range order for enhanced mechanical properties. The alloys include, in wt. %, about 16% Fe, 22–23% V, 0–10% Ni, additions (0.4–1.4% Ti, Zr, or Hf, 0.5% Al, 0.5% Ti+0.5% Al, 0.9% Ti+0.5% Al, 3.2% Nb, and 0.8% Ti+1.2% Nb+0.4% Ce), and balance Co. The ordered lattice of this alloy imparts improved strength, including an inverse relationship for yield strength as a function of temperature. Titanium (Ti) is substituted for V to improve the mechanical properties, and niobium (Nb) is added for improved creep properties.

U.S. Pat. No. 4,933,026 to Rawlings et al. discloses soft magnetic cobalt-iron alloys containing V and Nb. The alloys include, in wt. %, 34–51% Co, 0.1–2% Nb, 1.9% V, 0.2–0.3% Ta, or 0.2% Ta+2.1% V. Rawlings et al. also mentions previously known magnetic alloys containing 45–55% Fe, 45–55% Co and 1.5–2.5% V. The objective of the alloy of Rawlings et al. is to obtain high saturization magnetization combined with ductility. The ductility and magnetization of the alloy of Rawlings et al. is attributed to the addition of niobium (Nb). Additionally, Rawlings et al. mentions the use of such an alloy in applications such as pole tips and aerospace applications.

U.S. Pat. No. 5,252,940 to Tanaka discloses an Fe–Co alloy having a 1:1 ratio of Fe to Co and containing 2.1–5% V. The Fe–Co–V composition of Tanaka provides high energy efficiency under fluctuating DC conditions by reducing eddy currents.

FeCoV alloys are disclosed in U.S. Pat. Nos. 3,634,072; 3,891,475; 3,977,919; 4,116,727; 4,933,026; 5,067,993; 5,252,940; 5,501,747; 5,741,374; and 5,817,191, the disclosures of which, as they are related to thermomechanical precessing of such alloys, are hereby incorporated by reference.

According to an article by Phillip G. Colegrove entitled "Integrated Power Unit for a Moore Electric Airplane", AIAA/AHS/ASEE Aerospace Design Conference, Feb. 16, 1993, Irvine, Calif., an integrated power unit provides electric power for main engine starting and for in-flight emergency power as well as for normal auxiliary power functions. Such units output electric power from a switched-reluctance starter-generator driven by a shaft supported by magnetic bearings. The starter-generator is exposed to harsh conditions and environment in which it must function, e.g., rotational speeds of 50,000 to 70,000 rpm and a continuous operating temperature of approximately 500° C. The machine rotor and stator can be composed of stacks of laminations, each of which is approximately 0.006 to 0.008 inches thick. The rotor stack can be approximately 5 inches in length with a diameter of approximately 4.5 inches and the stator outside diameter can be about 9 inches. HiSat-50, an alloy produced by Telcon Metal Limited of England has been proposed for the rotor and stator laminations annealed at a temperature providing a desirable combination of strength and magnetic properties. The magnetic bearings are operated through attraction, rather than repulsion, of the shaft toward the magnetic force generator, the bearings exhibiting a desirable combination of bearing stiffness, load capability, allowable operating temperature and operational frequency. The operational temperature of the bearings can be on the order of 650° F.

Iron-cobalt alloys have been proposed for magnetic bearings used in integrated power units and internal starter/generators for main propulsion engines according to an article by Richard T. Fingers et al. entitled "Mechanical Properties of Iron-Cobalt Alloys for Power Applications." Two iron-cobalt alloys investigated include Hiperco™ alloy 50HS from Carpenter Technology Corporation and HS50 from Telcon Limited. After heat treating at 1300 to 1350° F. for 1 to 2 hours, tensile properties were evaluated for specimens prepared from rolled sheet 0.006 inches thick. Both materials are categorized as near 50—50 iron-cobalt alloys having a B2-ordered microstructure but with small percentages of vanadium to increase ductility and other additions for grain refinement. Alloy 50HS is reported to include, in weight percent, 48.75% Co, 1.90% V, 0.30% Nb, 0.05% Mn, 0.05% Si, 0.01% C, balance Fe whereas HS50 includes 49.5% Co, 0.27% V, 0.45% Ta, 0.04% Mn, 0.08% Si, balance Fe. The alloys annealed at 1300° F. are reported to exhibit the highest strength while those annealed at 1350° F. produced the lowest strength. According to the article, in development of motors, generators and magnetic bearings, it will be necessary to take into consideration mechanical behavior, electrical loss and magnetic properties under conditions of actual use. For rotor applications these conditions are temperatures above 1000° F. and exposure to alternating magnetic fields of 2 Tesla at frequencies of 500 Hz and the clamping of the rotor will result in large compressive axial loads while rotation of the rotor can create tensile hoop stresses of approximately 85 ksi. Because eddy current losses are inversely proportional to resistivity, the greater the resistivity, the lower the eddy current losses and heat generated. Resistivity data documented for 50HS annealed for 1 hour at temperatures of 1300 to 1350° F. indicate a mean room temperature resistivity of about 43 micro-ohm-cm whereas a value of 13.4 micro-ohm-cm is reported for HS50 annealed for 2 hours at temperatures of 1300 to 1350° F. The article concludes that both alloys appear to be good candidates for machine designs requiring relatively high strength and good magnetic and electrical performance.

Conventional soft magnetic alloys are used widely where high saturation magnetization values are important. However, their yield strengths are low at room temperature, and the strengths are even lower at high temperatures, making the alloys unsuitable for applications such as magnetic parts for jet engines that impose high temperatures and centrifugal stress on materials. Alloy design is critical for aerospace applications and becomes even more difficult when the magnetic requirements are imposed on the material along with the high temperature strength requirements. The room and high temperature strengths and high resistivity of the Fe–Co–V alloys of the present invention overcome these and other deficiencies of conventional soft magnetic alloys.

SUMMARY OF THE INVENTION

An Fe–Co–V alloy is provided in which the weight percent of constituents are such that (Fe+Co)≧90%, (Fe–Co)≧10%, and 1.5 to 10% V. The alloy can be iron-based, cobalt-based, or have no base metal. Additional alloying constituents include B, C, Nb, Ti, W, Ni and/or Mo.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which.

Figure 5:
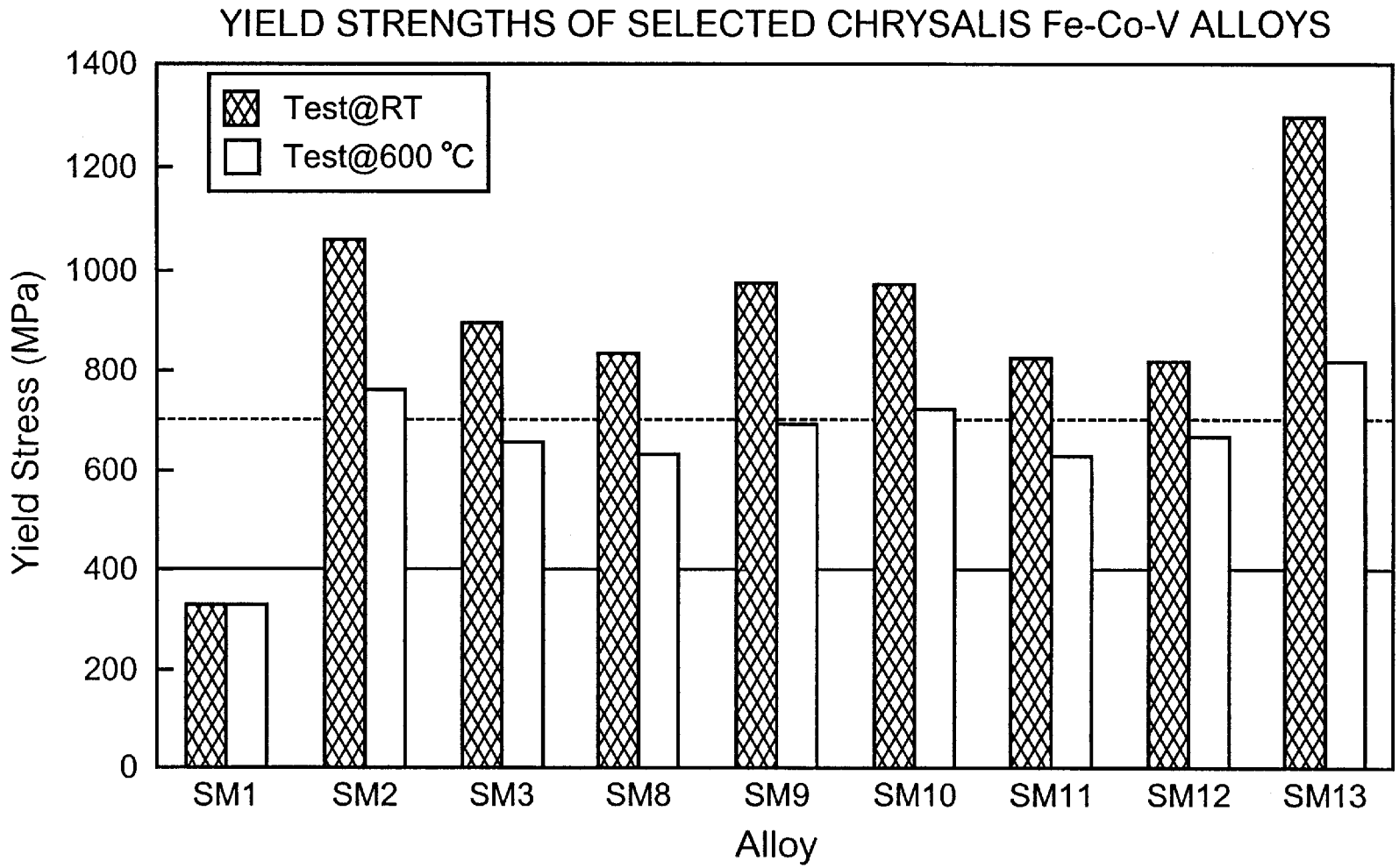
Figure 6:
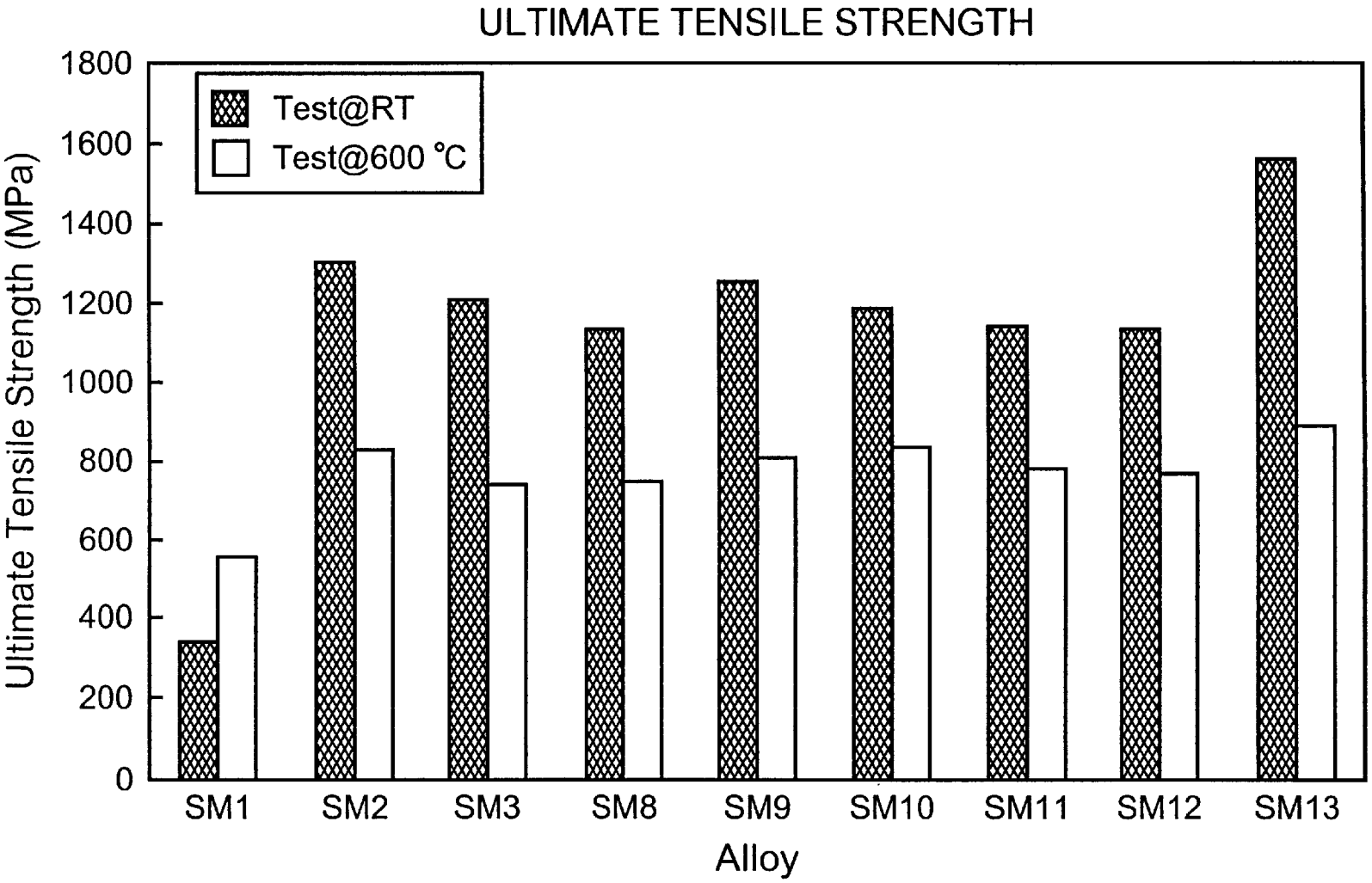
Figure 7:
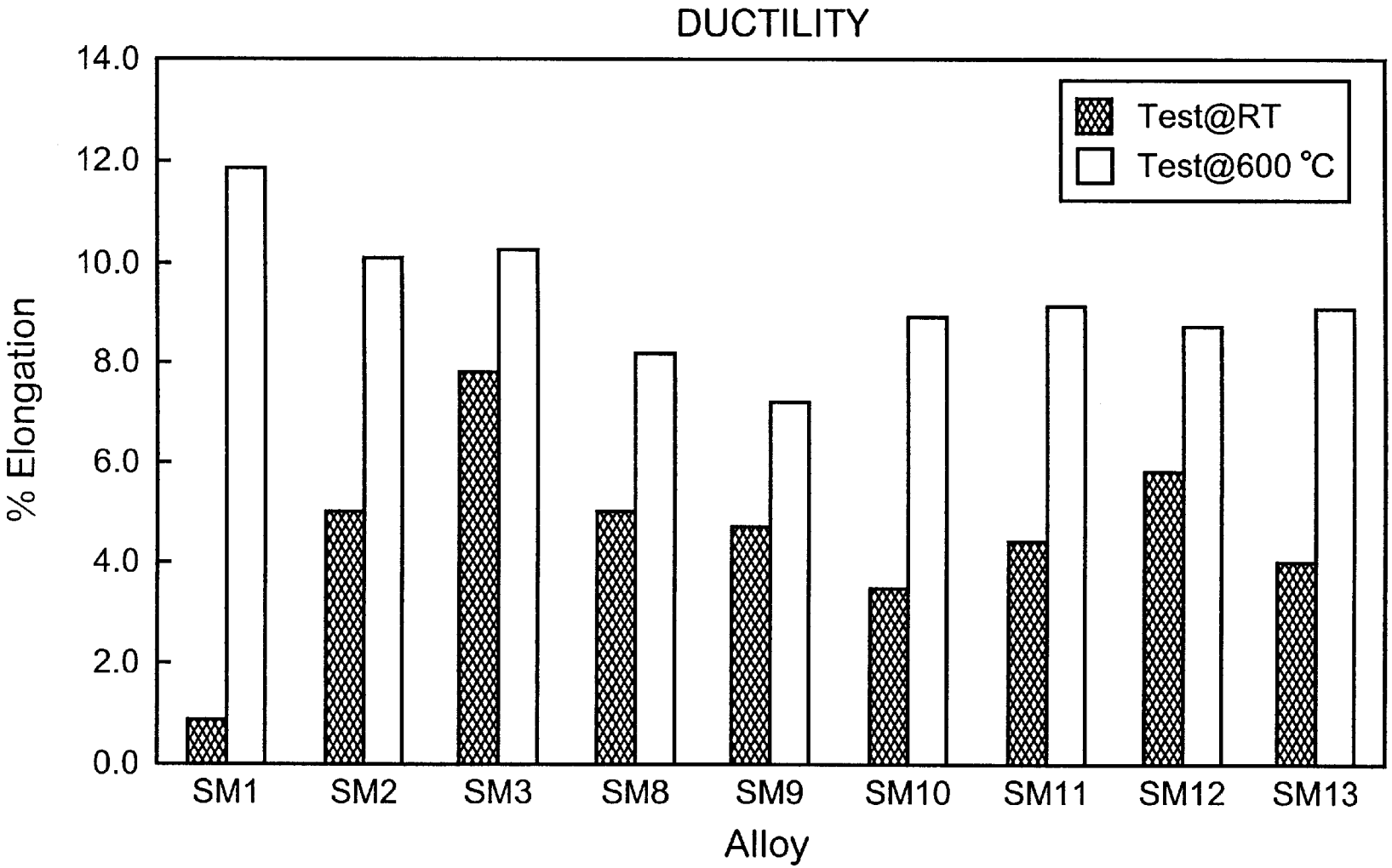
Figure 8:
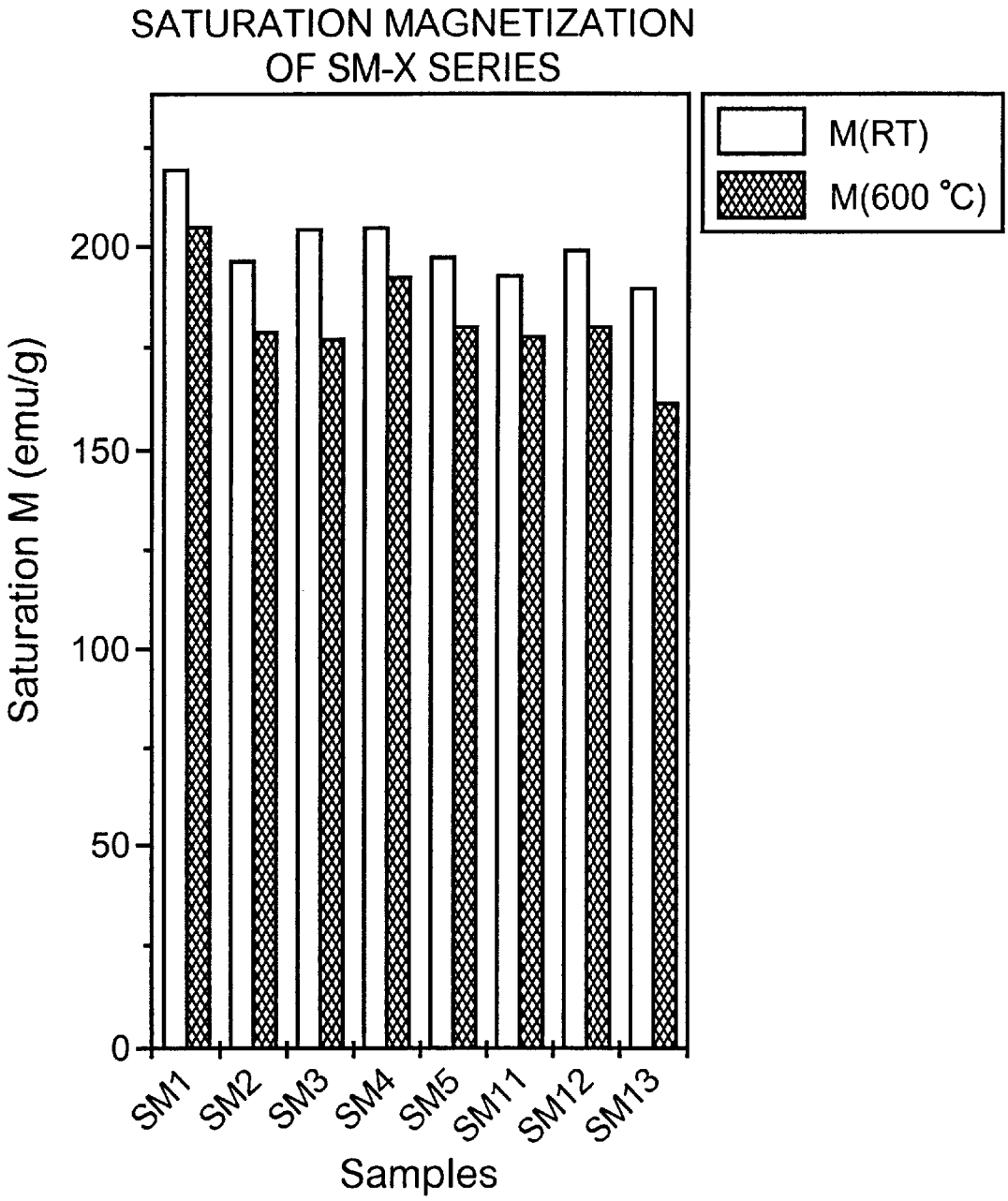
Figure 9:
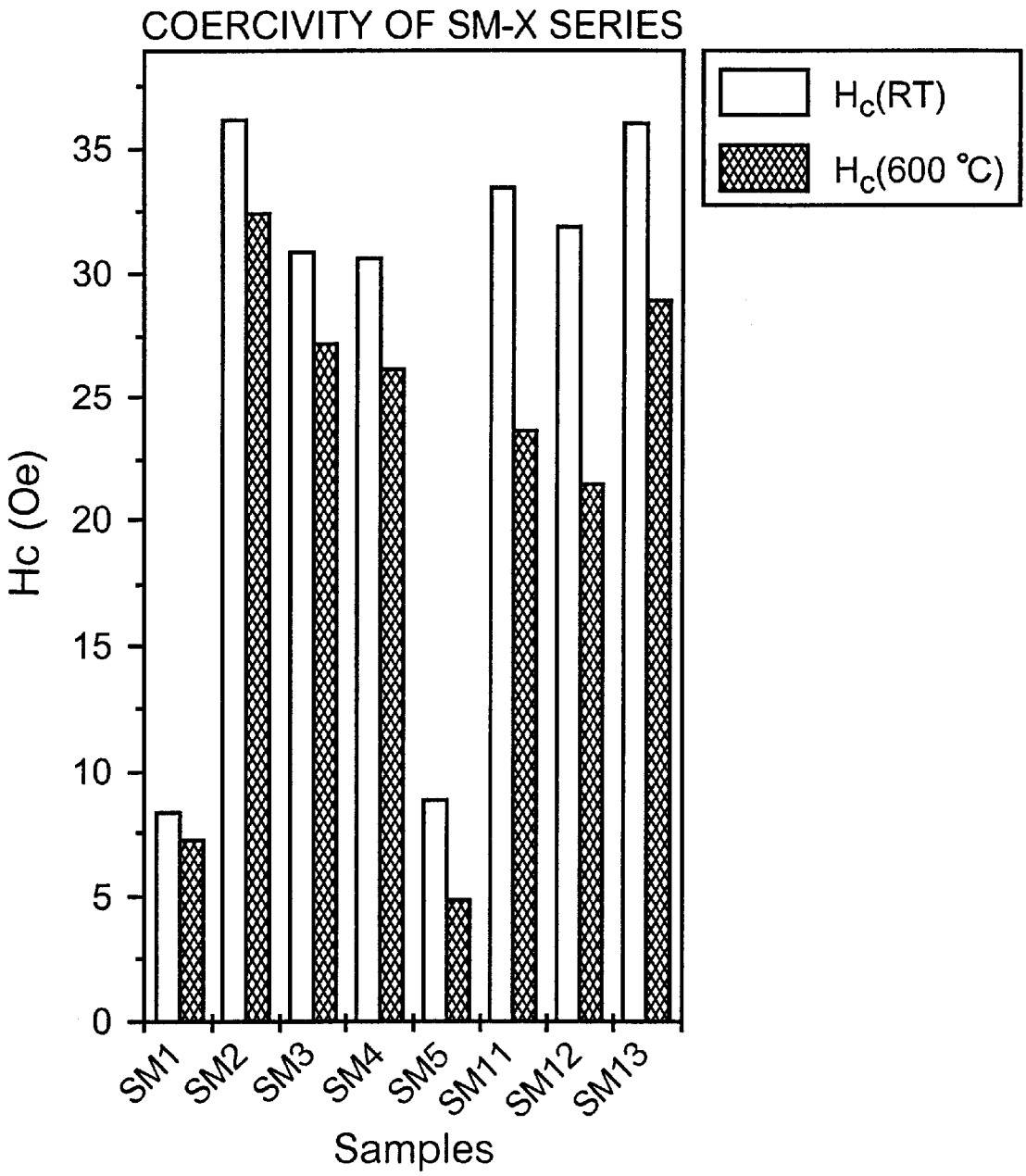
Figure 10:
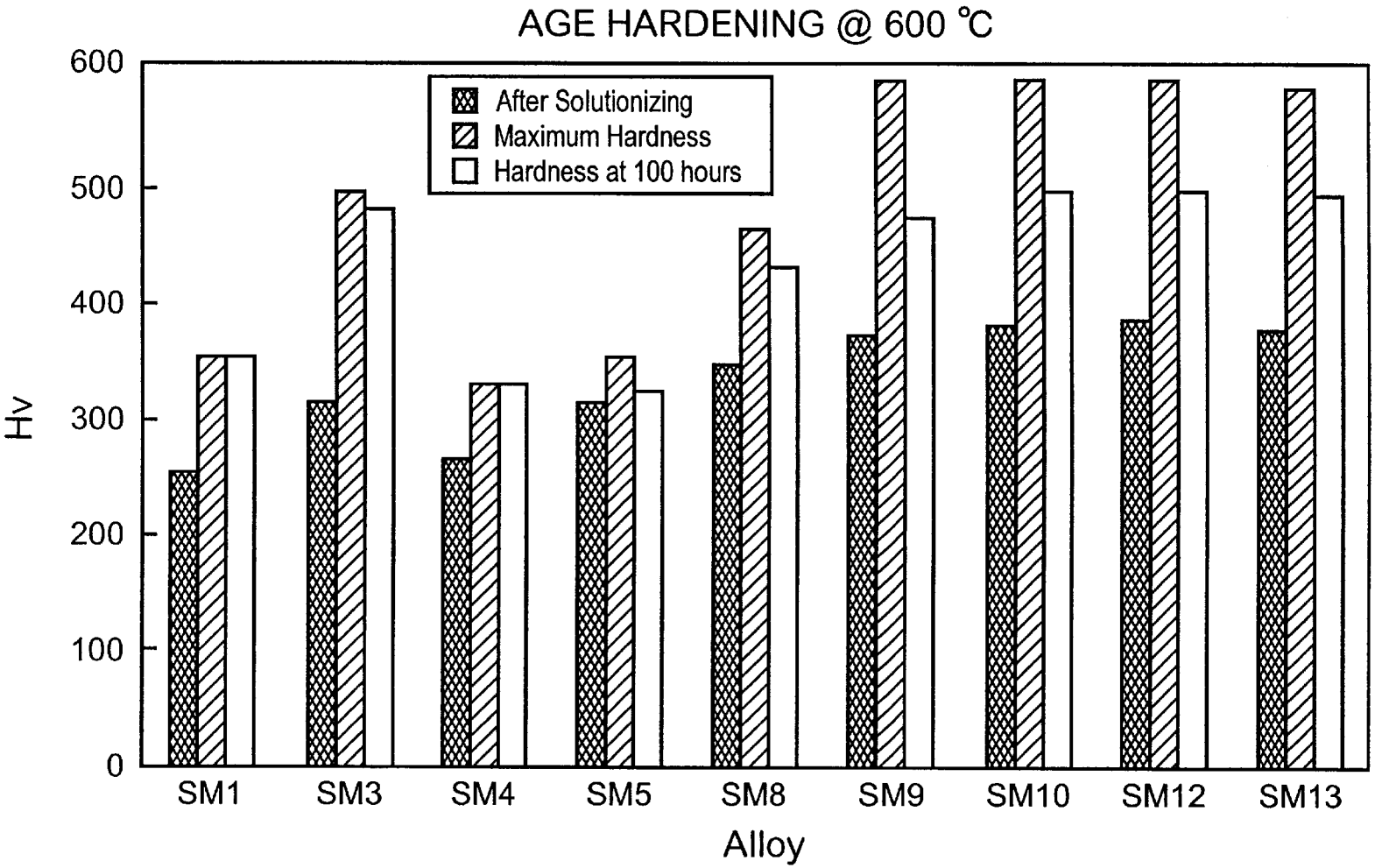
Figure 11:
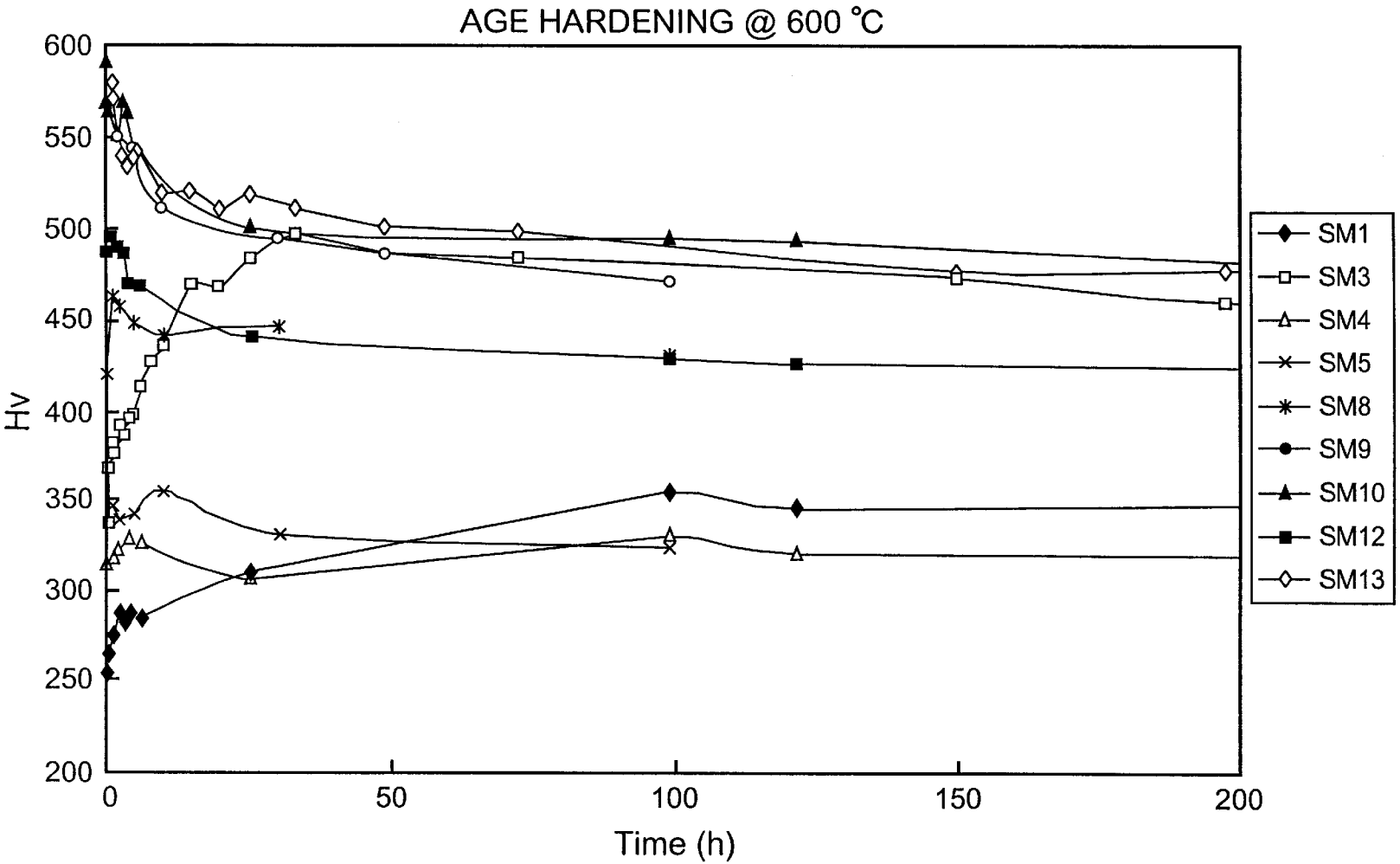
Figure 12:
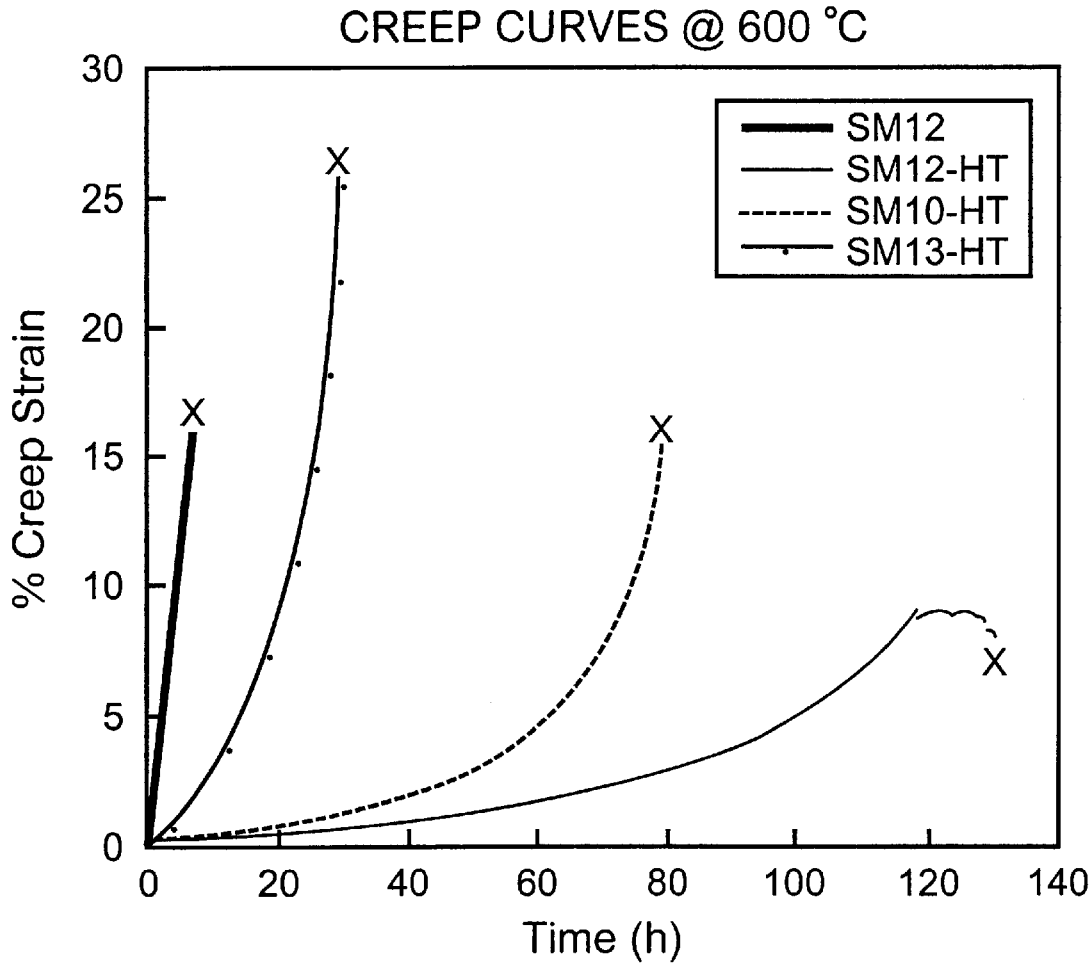
Figure 13:
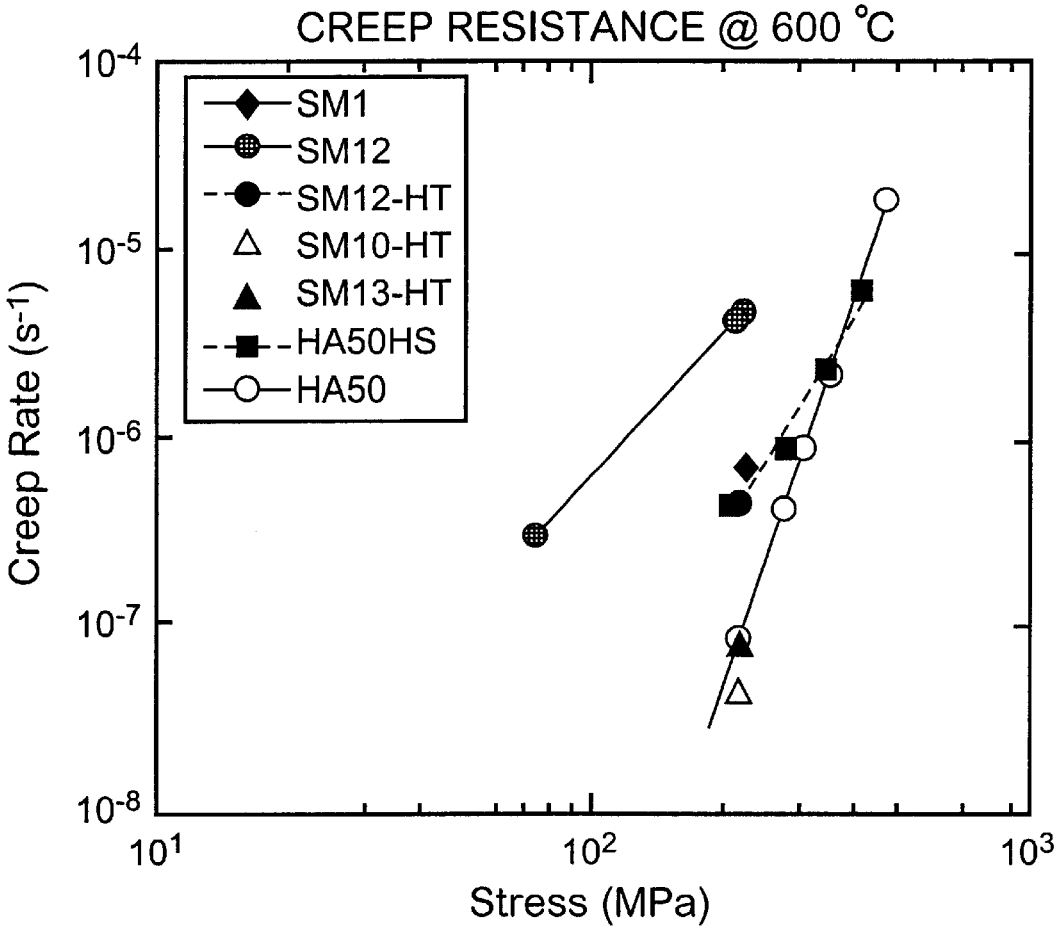
Figure 14:
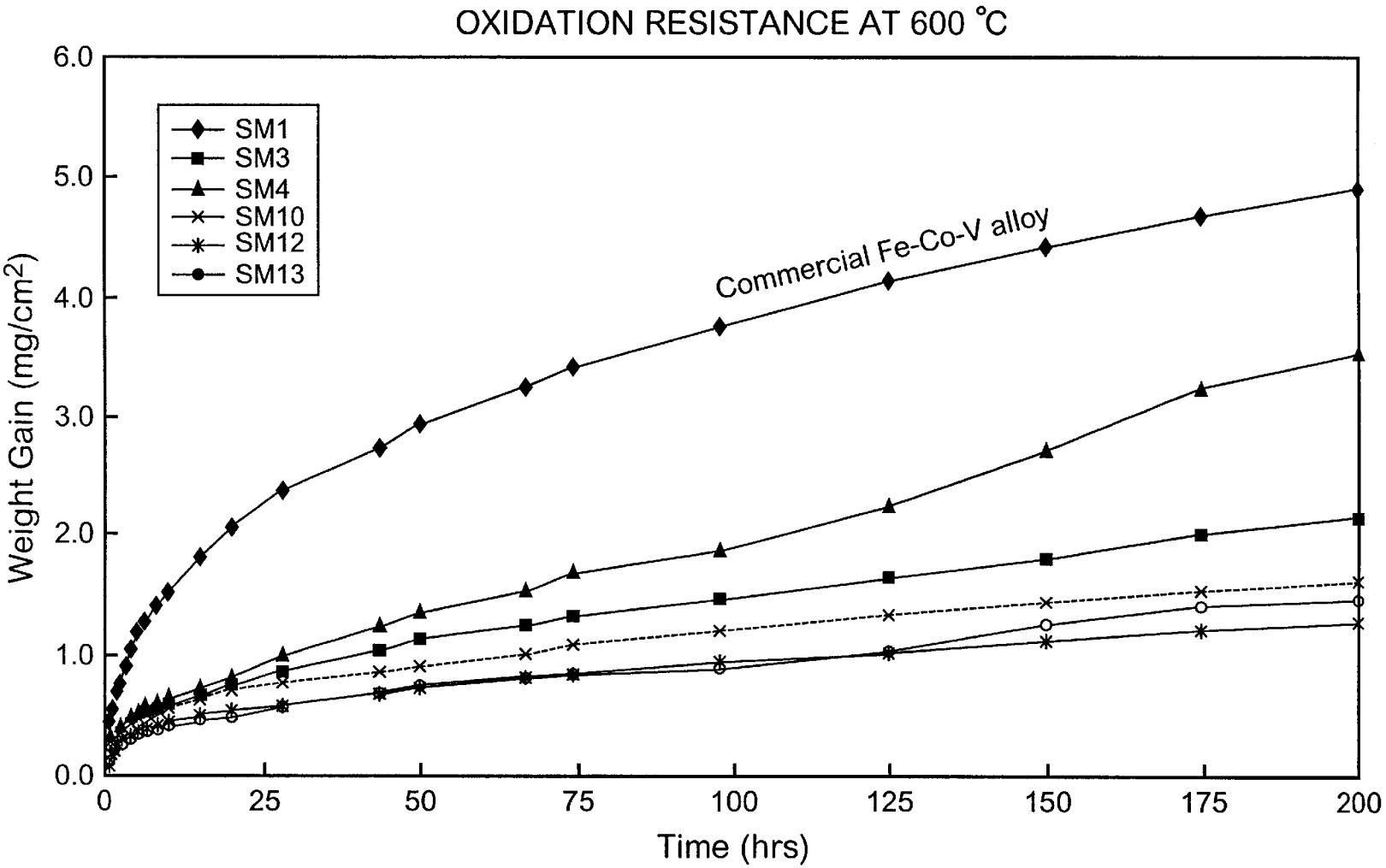

FIGS. 5–7 are graphs showing the results of tensile tests carried out at room temperature and 600° C. in air on stress relieved (700° C./2 hours and furnace cooled) sheet samples of gauge length of about 18 mm and thickness of about 0.7 mm. Yield strength, ultimate tensile strength and elongation to fracture (ductility) were measured from the stress-strain curves;

FIGS. 8–9 show magnetic property measurements (saturation magnetization and coercivity) measured using a magnetometer from room temperature to at least 600° C. The coercivity values are dependent on microstructure and can be decreased by appropriate heat treatment;

FIGS. 10 and 11 show hardness values for alloys solutionized at 1100° C. for 10 minutes, quenched in iced brine and aged at 600° C. FIG. 10 shows the maximum vickers hardness achieved and FIG. 11 shows the hardness after 100 hours of aging;

FIG. 12 shows creep data for alloys according to the invention tested in air at 600° C. under a stress of 220 MPa with and without the aging treatment (1100° C. for 10 minutes/iced brine quenching/aging at 600° C.) on sheet samples of gauge length of about 18 mm and thickness of about 0.7 mm. From the creep curves, the minimum creep rate and rupture time have been computed;

FIG. 13 shows the minimum creep rate at 600° C. as a function of stress applied to the samples; and FIG. 14 shows the static oxidation test results expressed as weight gain as a function of time at 600° C. for various alloys according to the invention.

DETAILED DESCRIPTION OF PREFERRED EMBODIMENTS

Table 1a provides exemplary compositions in weight % (and Table 1b provides the compositions in atomic %) of soft magnetic Fe–Co–V alloys. SM-1 is analogous to prior art Fe–Co–V alloys currently in commercial production whereas samples SM-1a–e are experimental variations thereof according to the invention. Samples SM-2 through SM-13c are inventive alloys. There are three general groupings of the alloys based on composition. The first grouping is a cobalt based alloy. SM-2 is an example of such a cobalt based alloy. A second grouping is an alloy with no base metal over 50 wt. %, where neither iron nor cobalt represent larger than 50 wt. % of the composition. SM-3 is representative of this group. The third grouping is a iron based alloy. SM-4 through SM-13 represent this grouping.

The compositions of the inventive cobalt-based Fe–Co–V alloy contain at least 1.5 wt. % vanadium, preferably 4 to 10% V. In comparison with the prior art SM-1 sample, characteristic properties of SM-2 will demonstrate the impact of increased vanadium content. Similarly, the characterization of samples SM-3 through SM-13 are designed to evaluate the impact of various alloying constituents on the properties of the alloy. In broad terms, the variations between compositions includes increasing the vanadium content to above 7 wt. % and adding boron, carbon, molybdenum, niobium, tungsten, nickel and titanium in varying combinations.

TABLE 1a

| | Composition (wt. %) | | | | | | | | | |
|---|---|---|---|---|---|---|---|---|---|---|
| Sample | Fe | Co | V | B | C | Mo | Nb | W | Ni | Ti |
| SM-1 (prior art) | Bal. | 50.43 | 1.78 | | | | | | | |
| SM-1a | Bal. | 50.11 | 1.95 | 0.01 | | 0.83 | 0.81 | | | |
| SM-1b | Bal. | 49.57 | 1.92 | 0.01 | | 0.82 | 0.80 | 1.58 | | |
| SM-1c | Bal. | 49.55 | 1.92 | 0.01 | | 0.82 | 0.80 | 1.58 | 1.01 | |
| SM-1d | Bal. | 49.03 | 1.90 | 0.01 | | 0.81 | 0.79 | 3.12 | | |
| SM-1e | Bal. | 49.59 | 1.92 | 0.01 | 0.01 | 0.82 | 0.80 | 1.58 | | |
| SM-2 | Bal. | 50.56 | 4.46 | | | | | | | |
| SM-2a | Bal. | 49.66 | 4.38 | 0.01 | 0.00 | 0.83 | 0.80 | 1.58 | 1.01 | |
| SM-3 | Bal. | 46.53 | 4.47 | | | | | | | |
| SM-4 | Bal. | 41.48 | 4.48 | | | | | | | |
| SM-4a | Bal. | 40.74 | 4.40 | 0.01 | 0.00 | 0.83 | 0.80 | 1.59 | 1.01 | |
| SM-4b | Bal. | 40.78 | 4.41 | 0.01 | 0.03 | 0.83 | 0.80 | 1.59 | 1.02 | |
| SM-5 | Bal. | 35.98 | 7.77 | | | | | | | |
| SM-5a | Bal. | 35.74 | 4.41 | 0.01 | | 0.83 | 0.80 | 1.59 | 1.02 | |
| SM-5b | Bal. | 35.35 | 4.36 | 0.01 | | 0.82 | 0.80 | 3.15 | 1.01 | |
| SM-5c | Bal. | 35.70 | 1.94 | 0.01 | 0.03 | 0.83 | 0.80 | 1.59 | 1.02 | |
| SM-6 | Bal. | 41.48 | 4.48 | 0.001 | | | | | | |
| SM-7 | Bal. | 41.53 | 4.49 | 0.001 | 0.03 | | | | | |
| SM-8 | Bal. | 41.38 | 4.47 | 0.001 | 0.03 | 0.84 | | | | |
| SM-9 | Bal. | 41.25 | 4.45 | 0.001 | 0.03 | 0.84 | 0.81 | | | |
| SM-10 | Bal. | 41.28 | 4.46 | 0.001 | 0.03 | 0.84 | 0.81 | | | 0.42 |
| SM-10a | Bal. | 40.83 | 4.41 | 0.01 | 0.03 | 0.83 | 0.80 | 1.59 | | 0.41 |
| SM-11 | Bal. | 41.41 | 4.47 | 0.001 | 0.03 | 0.84 | | | | 0.42 |
| SM-12 | Bal. | 41.42 | 4.47 | 0.001 | 0.03 | | 0.82 | | | 0.42 |
| SM-13 | Bal. | 36.33 | 7.71 | 0.001 | 0.03 | 0.85 | 0.82 | | | 0.42 |
| SM-13a | Bal. | 35.93 | 7.63 | 0.01 | 0.03 | 0.84 | 0.81 | 1.60 | | 0.42 |
| SM-13b | Bal. | 35.91 | 7.63 | 0.01 | 0.03 | 0.84 | 0.81 | 1.60 | | |
| SM-13c | Bal. | 35.87 | 7.62 | 0.01 | | 0.83 | 0.81 | 1.60 | | |

TABLE 1b

| | Composition (at. %) | | | | | | | | | |
|---|---|---|---|---|---|---|---|---|---|---|
| Sample | Fe | Co | V | B | C | Mo | Nb | W | Ni | Ti |
| SM-1 (prior art) | Bal. | 49 | 2 | | | | | | | |
| SM-1a | Bal. | 49 | 2.2 | 0.05 | | 0.5 | 0.5 | | | |
| SM-1b | Bal. | 49 | 2.2 | 0.05 | | 0.5 | 0.5 | 0.5 | | |
| SM-1c | Bal. | 49 | 2.2 | 0.05 | | 0.5 | 0.5 | 0.5 | 1.0 | |
| SM-1d | Bal. | 49 | 2.2 | 0.05 | | 0.5 | 0.5 | 1.0 | | |
| SM-1e | Bal. | 49 | 2.2 | 0.05 | 0.05 | 0.5 | 0.5 | 0.5 | | |
| SM-2 | Bal. | 49 | 5 | | | | | | | |
| SM-2a | Bal. | 49 | 5 | 0.05 | | 0.5 | 0.5 | 0.5 | 1.0 | |
| SM-3 | Bal. | 45 | 5 | | | | | | | |
| SM-4 | Bal. | 40 | 5 | | | | | | | |
| SM-4a | Bal. | 40 | 5 | 0.05 | | 0.5 | 0.5 | 0.5 | 1.0 | |
| SM-4b | Bal. | 40 | 5 | 0.05 | 0.15 | 0.5 | 0.5 | 0.5 | 1.0 | |
| SM-5 | Bal. | 35 | 8.6 | | | | | | | |
| SM-5a | Bal. | 35 | 5 | 0.05 | | 0.5 | 0.5 | 0.5 | 1.0 | |
| SM-5b | Bal. | 35 | 5 | 0.05 | | 0.5 | 0.5 | 1.0 | 1.0 | |
| SM-5c | Bal. | 35 | 2.2 | 0.05 | 0.15 | 0.5 | 0.5 | 0.5 | 1.0 | |
| SM-6 | Bal. | 40 | 5 | .005 | | | | | | |
| SM-7 | Bal. | 40 | 5 | .005 | 0.15 | | | | | |
| SM-8 | Bal. | 40 | 5 | .005 | 0.15 | 0.5 | | | | |
| SM-9 | Bal. | 40 | 5 | .005 | 0.15 | 0.5 | 0.5 | | | |
| SM-10 | Bal. | 40 | 5 | 0.005 | 0.15 | 0.5 | 0.5 | | | 0.5 |
| SM-10a | Bal. | 40 | 5 | 0.05 | 0.15 | 0.5 | 0.5 | 0.5 | | 0.5 |
| SM-11 | Bal. | 40 | 5 | .005 | 0.15 | 0.5 | | | | 0.5 |
| SM-12 | Bal. | 40 | 5 | .005 | 0.15 | | 0.5 | | | 0.5 |
| SM-13 | Bal. | 35 | 8.6 | 0.05 | 0.15 | 0.5 | 0.5 | | | 0.5 |
| SM-13a | Bal. | 35 | 8.6 | 0.05 | 0.15 | 0.5 | 0.5 | 0.5 | | 0.5 |
| SM-13b | Bal. | 35 | 8.6 | 0.05 | 0.15 | 0.5 | 0.5 | 0.5 | | |
| SM-13c | Bal. | 35 | 8.6 | 0.05 | | 0.5 | 0.5 | 0.5 | | |

The base constituents of the Fe–Co–V composition are iron and cobalt in proportion such that the sum of their composition is greater than 90 wt. % of the total. In addition, for the iron-based Fe–Co–V alloy, the difference between the proportion of iron and the proportion of cobalt is greater than or equal to 10 wt. %. The remaining compositional variations can be classified under two levels of vanadium: the first level being greater than 1.5%, preferably at least 4 wt. % and the second level being greater than 7 wt. %.

Figure 1:
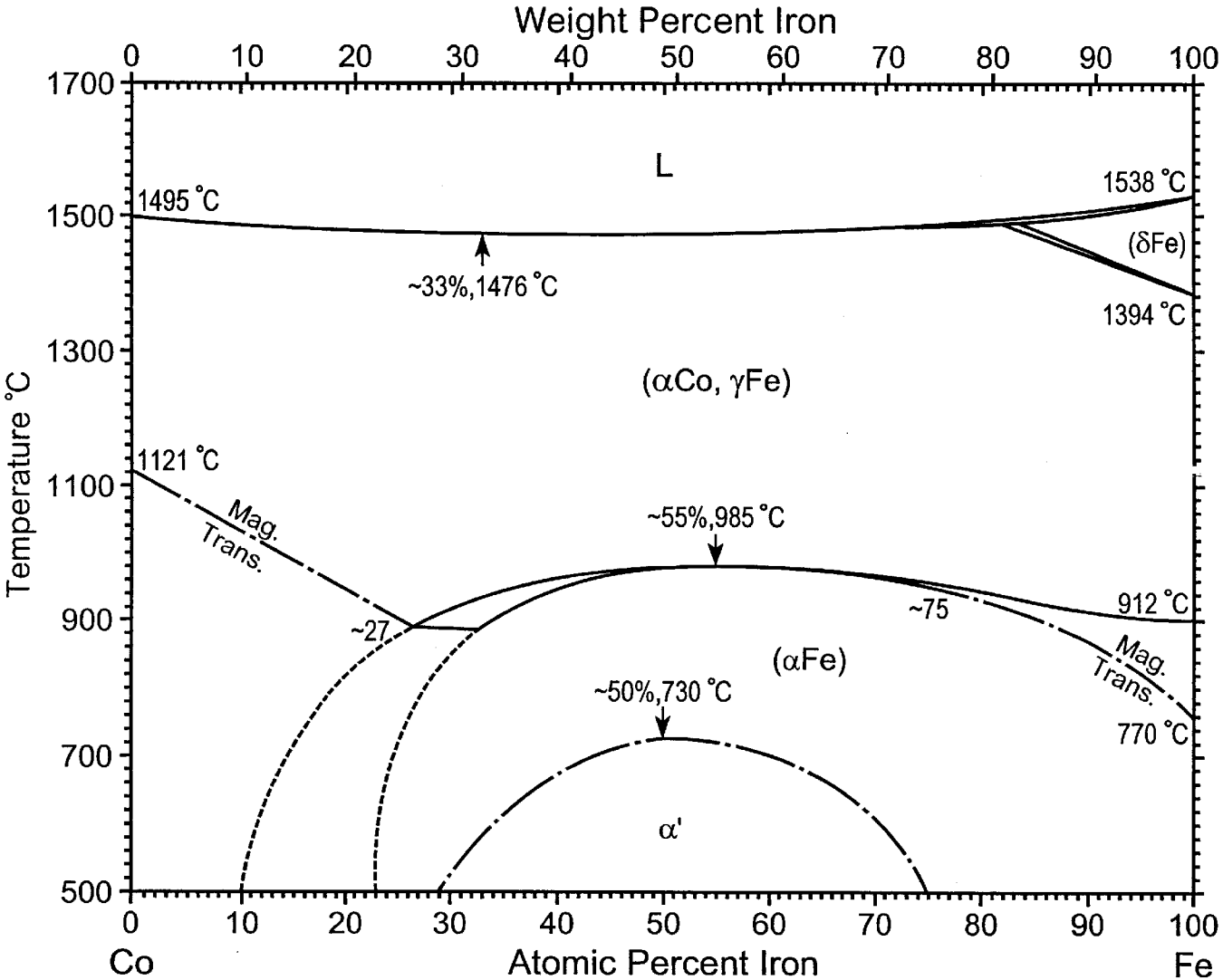
FIG. 1 is an Fe–Co equilibrium diagram indicating the composition range and ordering temperature of ordered Fe–Co alloys.
Figure 2:
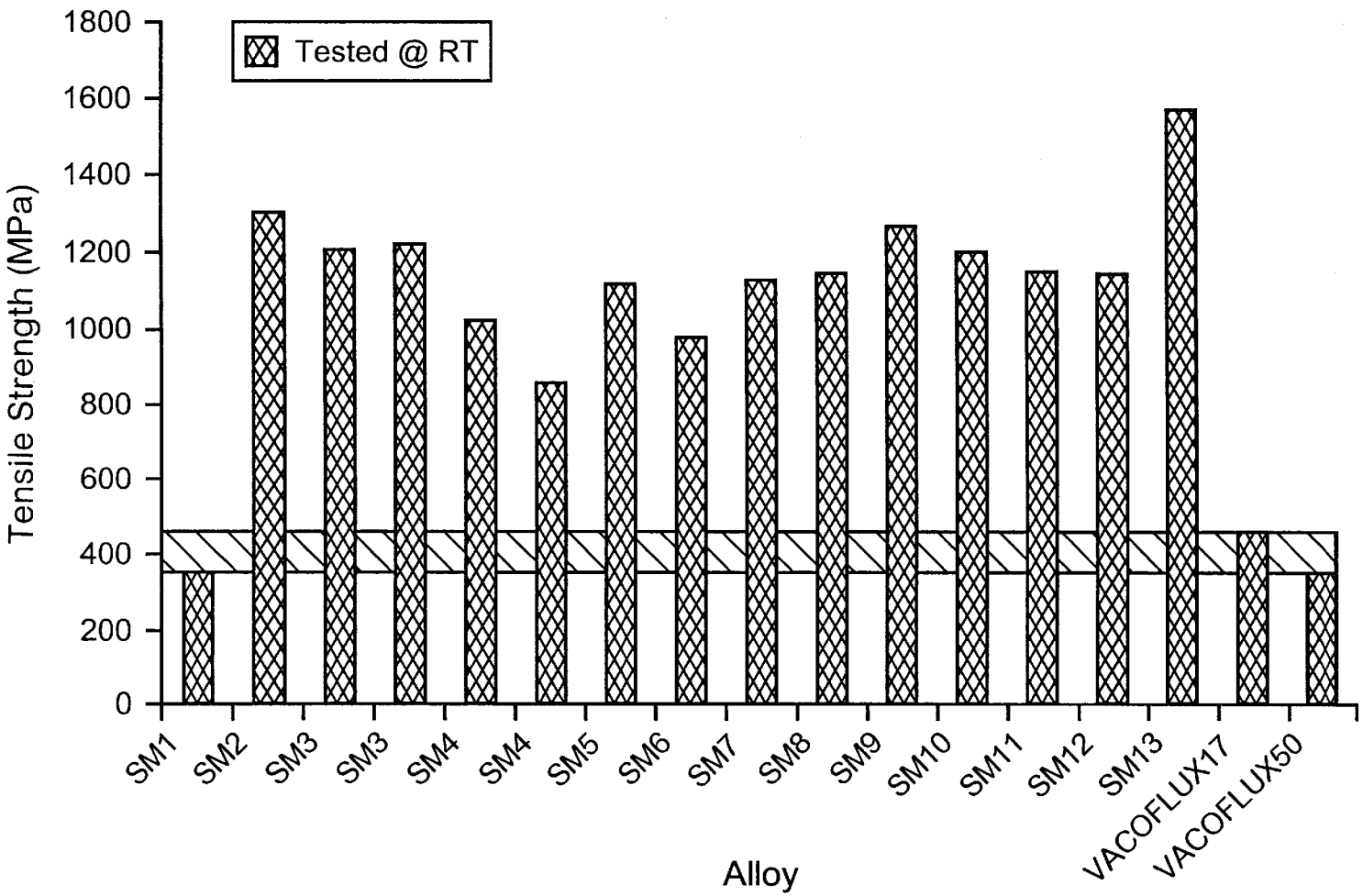
FIG. 2 shows tensile strength at room temperature for alloys according to the invention.

FIG. 2 shows tensile strength at room temperature for various inventive alloys. Prior art alloy SM-1 and prior art alloys Vacoflux-17 and Vacoflux-50 are also included. These last two prior art samples are commercial products available from Vacuumschmelze GbmH of Germany. As shown in FIG. 2, the tensile strength in MPa for prior art commercially available Fe–Co–V alloys is typically in the range of from 350–450 MPa. In contrast, the inventive samples show a tensile strength of at least 500 MPa, preferably at least 800 MPa. Inventive sample SM-2 displays a tensile strength of greater than 1200 MPa. SM-2 has an increased vanadium and lower Co content compared to prior art sample SM-1 and the other prior art samples. Therefore, the very large increase and tensile strength exhibited by SM-2 may be attributed to the increased vanadium and reduced cobalt content.

SM-3 represents an inventive sample in which no base metal over 50 wt. % is present. Here, as in sample SM-2, the vanadium content is greater than 4 weight percent. From FIG. 2, it can be seen that the tensile strength of SM-2 and SM-3 are comparable, both being approximately 1200 MPa. Therefore, one can conclude that the tensile strengths depicted by SM-2 and SM-3 are more strongly associated with the increased vanadium content than in small variations between the iron and cobalt as the base metal.

SM-4 and SM-5 are inventive iron-based samples in which the vanadium content is varied between 4 and 8 wt. %, with the balance of the composition being cobalt. The tensile strength for SM-4 and SM-5 is in the range of 850 to 1100 MPa. This is a higher tensile strength than that exhibited by the prior art samples. This may be attributed to the increased vanadium content as supported by results from increasing the vanadium in other inventive alloys. In addition, iron based alloys do not have as high a tensile strength as the cobalt-based alloy or the alloy with no-base metal. Even between the two inventive alloys SM-4 and SM-5, an increase in vanadium from about 4.5 to about 7.5 wt. % increases the tensile strength and supports the conclusion of the beneficial strengthening effect of the V. The results from SM-5 support this conclusion.

Remaining inventive samples SM-6 to SM-13 show, in general, that the iron based alloy of the present invention has a tensile strength approximately double that of the prior art samples. SM-13 shows an increase in vanadium content correlates to an increase in tensile strength.

Figure 3:
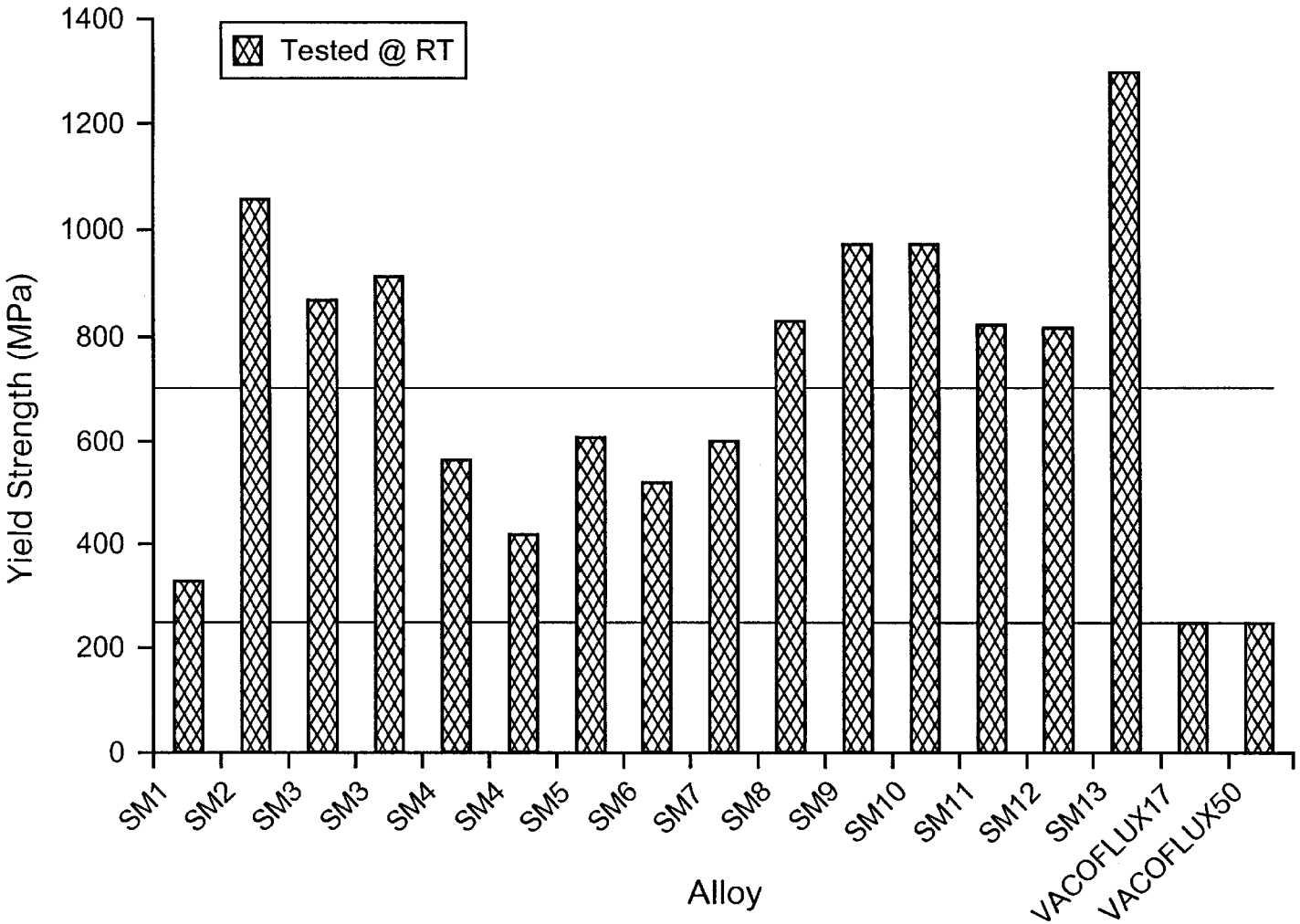
FIG. 3 shows yield strength at room temperature for alloys according to the invention.

FIG. 3 shows yield strength at room temperature for inventive alloys relative to the comparative sample and the Vacoflux alloys. In general, prior art Fe–Co–V alloys may be characterized by yield strengths of 250–350 MPa. In contrast, the inventive samples SM-2 through SM-13 display a minimum yield strength of 400 MPa and preferred yield strengths of about 600 to 800 MPa. The highest yield strength was found for inventive sample SM-13 and was greater than 1,200 MPa.

The trends in yield strength amongst the inventive samples are similar to those discussed for tensile strength. For the cobalt-based Fe–Co–V alloys in which the vanadium content is increased over the prior art samples, a yield strength of over 1,000 MPa has been determined. This implies that the increase in vanadium to greater than 4 weight percent has a demonstrable increase in yield strength. Likewise, for inventive sample SM-3 which is an alloy with no-base material over 50%, the yield strength is comparable to SM-2. This indicates that the vanadium content may be the controlling factor in realizing such high yield strengths independent of variations in the base materials. For iron-based Fe–Co–V alloys, inventive samples SM-4 and SM-5 exhibit a yield strength between 400–600 MPa. The increase in vanadium content from 4 to 7 wt. % (e.g. inventive sample SM-5) indicates that an increase in vanadium contributes to an increase in yield strength.

Inventive samples SM-6 through SM-13 are iron-based alloys with varying compositional constituents. Amongst these samples, all have a yield strength above 500 MPa which is an approximate 50% increase over the prior art and for SM-13 in which the vanadium content is greater than 7 wt. %, the yield strength is unexpectedly increased to 1,300 MPa.

Figure 4:
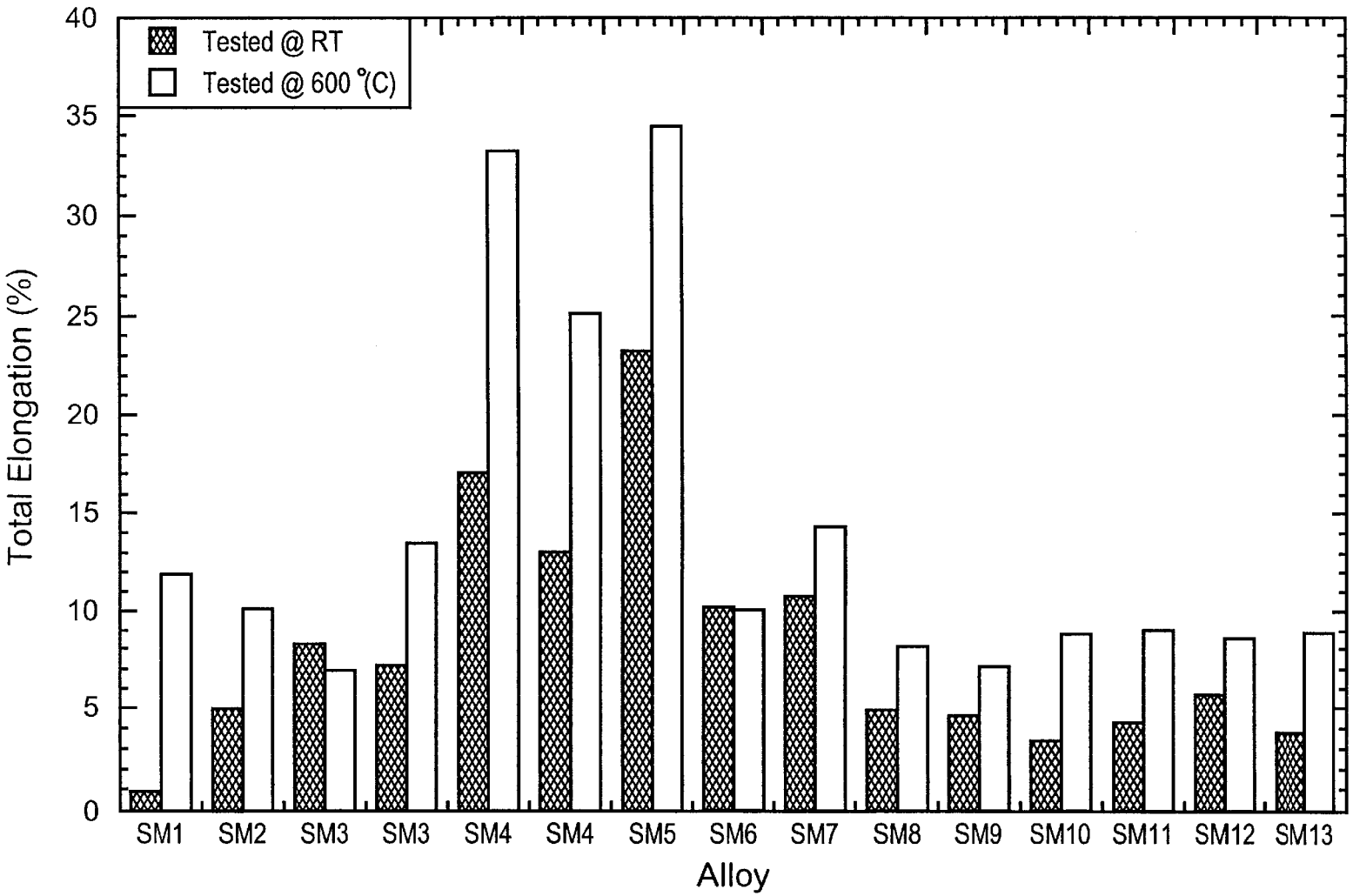
FIG. 4 shows total elongation for alloys according to the invention at room temperature and at 600° C.

FIG. 4 shows total elongation for alloys at room temperature and at 600° C. Prior art sample SM-1 is representative of currently available commercial products. For SM-1, the room temperature total elongation is approximately 1% and at 600° C., the total elongation is approximately 12%. Inventive samples SM-4 and SM-5 show unexpected improvement in total elongation compared to the prior art sample. SM-4 and SM-5 are iron based Fe–Co–V alloys, SM-5 having higher V than SM-4. The surprising increase in total elongation to greater than approximately 15% at room temperature and greater than approximately 25–30% at 600° C. may be attributed to the increase in vanadium of the base alloy from 4 to greater than 7 wt. %. Samples SM-6 through SM-13 show total elongations at least as good as those exhibited by the prior art samples.

Inventive alloys SM-2 through SM-13 have been developed to provide next generation iron-cobalt-vanadium alloys as magnetic materials with exceptional high strength. Table 1 has provided the compositions of soft magnetic alloys designed to meet these goals. Several different alloying additions have been added as shown in Table 1 to improve the strength at room temperature and retain the strength at high temperatures. It is most preferable to obtain alloys exhibiting exceptionally good creep resistance at 600° C. for a period of up to 5,000 hours. The yield strength of these alloys indicate that the strengths of SM-2 through SM-13 are significantly higher than the prior art commercial alloys. In addition, several alloys meet the stringent criteria of 700 MPa at room temperature. Tensile strengths of these alloys are also significantly higher than the commercial alloys. Indeed, one of the alloys, SM-13, has a yield strength of over 1,300 MPa with a tensile strength of about 1,600 MPa. Such a material would be very useful for high strength applications.

The inventive alloys SM-2 through SM-13 exhibit high electrical resistivity. High resistivity reduces eddy currently losses. Therefore, these alloys will reduce the eddy current losses compared to currently existing commercial alloys, e.g., up to 50% reduction in eddy current losses.

The improved temperature dependent strength properties, magnetization saturation, and eddy loss performance are expected to provide advantages over known alloys in current commercial applications such as electric generator pole shoes, high performance motors, and aerospace applications.

The alloys according to the invention are useful for various applications including: internal starter/generator for aircraft jet engines, high performance transformers, laminated material for electrical engines and generators, pole tips for high field magnets, magnetically driven actuators for devices such as impact printers, diaphragms for telephone handsets, solenoid valves of armature-yoke systems such as in diesel direct fuel injection engines, magnetostrictive transducers, electromagnetically controlled intake and exhaust nozzles, flux guiding parts in inductive speed counters for antilock brake systems, magnetic lenses, solenoid cores for fast response magnetic switches, magnetic circuits operated at high frequencies, etc. Because the alloys of the invention exhibit high strength at high temperatures while providing desired magnetic properties, they are useful as bearings, stators and/or rotors of internal starter/generator units for aircraft jet engines wherein the operating temperatures can be on the order of 550° C. while such parts are subject to alternating magnetic fields of 2 Tesla at frequencies of 500 Hz. The alloys of the invention also exhibit other properties desirable in such environments such as a yield strength of at least 700 MPa, an electrical resistivity of 40 to 60 micro-ohm-cm, a high creep rate at 550° C. and good corrosion resistance. The alloys of the invention are useful in high performance transformers due to their high flux density, high saturation induction, high Curie temperature, high permeability and low coercivity. The alloys of the invention are useful as laminated material for electrical engines and generators wherein the operating temperatures are on the order of 200° C. and higher. The alloys can also be used for pole tips for high field magnets since the alloys exhibit normal permeability at high induction. The alloys can be used for magnetically driven actuators in devices such as impact printers since the alloys exhibit low magnetic losses under rapidly fluctuating electric current. Because of their high normal permeability and high incremental permeability at high induction as well as exhibiting suitable mechanical properties, the alloys of the invention are useful as diaphragms in telephone handsets. The alloys can be used as solenoid valves of armature-yoke systems in diesel direct injection fuel systems since the alloys exhibit sufficient strength to withstand high fuel pressure. Because the alloys exhibit low eddy current losses (low coercivity) and high resistivity at small thicknesses (to increase the operating frequency range), the alloys are useful as magnetically actuated parts such as solenoid cores and fast response magnetic switches or in magnetically excited circuits operating at high frequencies.

The iron-cobalt alloys according to the invention have improved strength and creep resistance as well as good magnetic properties and oxidation resistance. The alloys can include additions of V, Mo, Nb, Ti, W, Ni, C, B and mixtures thereof. For instance, the alloys can include, in weight %, 30 to 51% Co, 2 to 8% V, 0.2 to 3.0% Mo, 0.5 to 2.0% Nb, 0.3 to 2.0% Ti, 1 to 5% W, 1 to 2% Ni, 0.01 to 0.1% C, and/or 0.001 to 0.02% B.

The alloys according to the invention exhibit desirable combinations of useful properties in the various applications mentioned above. For instance, the alloys can exhibit a yield strength of at least 500 MPa at room temperature and 400 MPa at 600° C. Such alloys can exhibit yield strengths at room temperature up to 1300 MPa and up to 800 MPa at 600° C. The alloys can exhibit an ultimate tensile strength of at least 800 MPa at room temperature and 600 MPa at 600° C. The alloys can exhibit elongation of at least 3.5% at room temperature and at least 7.5% at 600° C. The elongations can be as high as 23% at room temperature and 35% at 600° C. The alloys exhibit good creep resistance at 600° C. For instance, the alloys can exhibit a minimum creep rate of $5\times10^{-8}$ $s^{-1}$ under a stress of 200 to 600 MPa. The alloys can exhibit a saturation magnetization of at least 190 emu/g at room temperature and good retention of such properties at high temperatures on the order of 600° C. Depending on composition, the alloys can exhibit a saturation magnetization of more than 200 emu/g. The alloys exhibit good electrical resistivity, e.g., 40 to 100 micro-ohm-cm. The alloys exhibit oxidation resistance better than that of commercially available FeCoV alloys, e.g., a weight gain of 1.0 $mg/cm^2$ or lower at 600° C. after 200 hours.

The soft magnetic materials according to the invention exhibit a desirable combination of properties useful for the various applications mentioned above. For instance, the alloys exhibit a high Curie temperature (Tc), e.g., a Curie temperature on the order of 650 to 720° C. The alloys also exhibit a high saturation magnetization (Ms), e.g., 2 to 2.35 Tesla. The alloys also exhibit a high yield strength at room temperature, e.g., a yield strength of at least 700 MPa at room temperature. The alloys also exhibit high creep resistance, e.g., a creep rate of $10^{-8}$ to $10^{-10}$/sec under stresses of 200 to 600 MPa at temperatures on the order of 500 to 650° C. for extended periods of time such as 5000 hours. The alloys also exhibit high electrical resistivity, e.g., 40 to 100 micro-ohm-cm. In addition, the alloys exhibit good ductility and good formability, good dynamic properties in the form of laminated composites, good corrosion resistance and good cost to performance ratio.

Compared to commercial FeCoV alloys, the alloys according to the invention are more economical due to their lower Co content, higher strength at room temperature and elevated temperatures such as 600° C., and/or good to excellent room temperature ductility in the ordered state while exhibiting comparable creep resistance and magnetic properties. In addition, the alloys according to the invention exhibit higher resistivity and better oxidation resistance compared to the commercial FeCoV alloys.

The alloys according to the invention can be processed by various techniques including casting, powder metallurgy and plasma spraying processes. For instance, the alloy can be cast into a billet, the billet can be forged at a temperature of 900 to 1100° C. to break down the cast structure, the forging can be hot rolled to form a sheet, the hot rolled sheet can be quenched from a high temperature on the order of 950° C. into an ice brine solution below 0° C. so as to form a sheet having a disordered crystal structure, the sheet can be cold rolled to a desired size (e.g., the sheet can be rolled with reductions of 60 to 90%), the cold rolled sheet can be annealed, e.g., the alloy can be age hardened at 400 to 700° C. for up to 50 hours in air. In the powder metallurgical process, the alloy can be atomized, the atomized powder can be mixed with a binder and the powder mixture can be formed into a desirable shape such as a sheet by roll compaction or tape casting, the sheet can be heated to volatilize the binder followed by partial sintering, the partially sintered sheet can be cold rolled to a desired thickness and the cold rolled sheet can be annealed, e.g., age hardened. If desired, the atomized powder can be formed into a sheet by plasma spraying and the plasma sprayed sheet can be cold rolled and annealed such as by age hardening. In addition to using atomized powder for the roll compaction/tape casting/plasma spraying process described above, the atomized powder can be mechanically alloyed to include an oxide dispersoid such as $Y_2O_3$ therein. The powder mixture can be ground with suitable grinding media such as zirconia or stainless steel balls for an appropriate period of time such as 2–20 hours so as to achieve a desired particle size and obtain a uniform distribution of oxide particles in the ground mixture. The powder mixture can be processed as described above and after the heat treatment the sheet can have an oxide content of 0.5 to 2 wt. % and/or an average grain size of 1 to 30 microns.

In making laminated products with the sheet according to the invention, it may be desired to include an insulating barrier between layers. Such an insulating barrier can be provided by applying a thin film coating on the surfaces of the sheet. For instance, an insulating material such as iron aluminide (insulating at elevated temperatures) can be applied to the sheet by any suitable technique such as sputtering or cathodic arc deposition. Alternatively, an oxide coating such as alumina can be provided on the sheet by any suitable technique such as sol gel processing. The thus coated sheets can be assembled into a laminated article and held together by any suitable technique, e.g., mechanically attached by suitable clamping or metallurgically bonded by brazing, etc.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A high strength soft magnetic Fe–Co–V alloy, comprising, in weight %, (Fe+Co)≧88%, (Fe–Co)≧2% or (Co–Fe)≧2%, at least 30% Co, and satisfying the following condition:

(1) 0.05 to 4% Mo and 1.5 to 10% V, and optionally satisfying the following condition:

(2) (Fe–Co)≦13 or (Co–Fe)≦13, 0.001 to 0.3% B and at least 4% V.

2. The alloy of claim 1, further comprising 0.0005 to 0.3% B, 0.005 to 0.3%C, 0.05 to 4% Nb, 0.05 to 4% Ti, 0.05 to 4% W, 0.05 to 4% Ni or mixtures thereof.

3. The alloy of claim 1, further comprising 0.005 to 0.2% B, 0.01 to 0.2%C, 0.5 to 2% Nb, 0.3 to 1% Ti, 0.1 to 1.5% W, 0.1 to 1.5% Ni or mixtures thereof.

4. The alloy of claim 1, comprising 0.1 to 1% Mo.

5. The alloy of claim 1, wherein the alloy is nickel free and/or chromium free.

6. The alloy of claim 1, wherein the alloy exhibits a room temperature ultimate tensile strength of at least 800 MPa.

7. The alloy of claim 1, wherein the alloy exhibits a room temperature yield strength of at least 400 MPa.

8. The alloy of claim 1, wherein the alloy exhibits a yield strength at 600° C. of at least 400 MPa.

9. The alloy of claim 1, wherein the alloy exhibits a total elongation at room temperature of at least 3%.

10. The alloy of claim 1, wherein the alloy exhibits a total elongation at 600° C. of at least 7%.

11. The alloy of claim 1, wherein the alloy exhibits creep resistance at 600° C. under a stress of at least 200 MPa of at least $10^{-8}$/sec.

12. The alloy of claim 1, wherein the alloy exhibits room temperature saturization magnetization of at least 190 emu/g.

13. The alloy of claim 1, wherein the alloy exhibits electrical resistivity of at least 40 $\mu$ohm-cm.

14. The alloy of claim 1, wherein the alloy exhibits weight gain of 1 mg/cm$^2$ or less when exposed to air for 200 hours at 600° C.

15. The alloy of claim 1, wherein the alloy comprises a sheet prepared by casting, forging, hot rolling, cold rolling and age hardening.

16. The alloy of claim 1, wherein the alloy comprises a sheet prepared by forming the alloy into powder, mixing the powder with a binder, forming the powder mixture into a sheet, heating the sheet to remove the binder and sintering the alloy powder, cold rolling the sintered sheet, and heat treating the rolled sheet.

17. The alloy of claim 1, wherein the alloy is formed into powder, the powder is plasma sprayed into a sheet, the sheet is cold rolled and the cold rolled sheet is heat treated.

18. The alloy of claim 1, wherein the alloy is formed into powder, the powder is mechanically alloyed with oxide particles, the mechanically alloyed powder is formed into a sheet, the sheet is cold rolled and the cold rolled sheet is age hardened.

19. The sheet of claim 18, having an oxide dispersoid content of 0.5 to 2 wt. % and/or an average grain size of 1 to 30 $\mu$m.

20. The alloy of claim 1, wherein the alloy is formed into a sheet having an insulating coating thereon and the coated sheets are overlapped to form a laminated stator or rotor of a starter/generator for an aircraft jet engine.

21. The alloy of claim 1, wherein the alloy is formed into a magnetic bearing by casting the alloy on sintering powders of the alloy.

22. The alloy of claim 1, comprising a part of a high performance transformer, a laminated part of an electrical generator, a pole tip of a high field magnet, a magnetically driven actuator of a device such as an impact printer, a diaphragm of a telephone handset, a solenoid valve of an armature-yoke system of a diesel injection engine, a magnetostrictive transducer, an electromagnetically controlled intake or exhaust nozzle, a flux guiding part of an inductive speed counter of an antilock brake system, a magnetic lens, a solenoid core of a magnetic switch or part of a magnetically excited circuit.

23. A high strength soft magnetic Fe–Co–V alloy, comprising, in weight %, (Fe+Co)≧88%, (Fe–Co)≧2% or (Co–Fe)≧2%, at least 30% Co, and satisfying one or more of the following two conditions:

(1) 0.05 to 4% Mo and 1.5 to 10% V, or (2) (Fe–Co)≦13 or (Co–Fe)≦13, 0.001 to 0.3% B and at least 4% V; and wherein the alloy includes 0.0005 to 0.3% B, 0.005 to 0.3% C, 0.05 to 2% Mo, 0.05 to 2% Nb, 0.05 to 2% W, and 0.05 to 2% Ni.

* * * * *